US005841062A

United States Patent [19]

Manole et al.

[11] Patent Number: 5,841,062

[45] Date of Patent: Nov. 24, 1998

[54] TANK CARTRIDGE

[75] Inventors: Leon Manole, Great Meadows; Stewart Gilman, Wharton; James Lee, Parsippany; Manuel Munoz, Paterson; Peter Ngai, Morris Plains; Anthony Vella, Bloomfield; William Rice, Succasunna; Nick Zuback, Carteret, all of N.J.

[73] Assignee: The United States of America as represented by the Secretary of the Army, Washington, D.C.

[21] Appl. No.: 958,640

[22] Filed: Oct. 27, 1997

Related U.S. Application Data

[60] Provisional application No. 60/030,401, Oct. 29, 1996, and provisional aplication No. 60/045,998, May 8, 1997.

[51] Int. Cl.[6] ..... F42B 5/18

[52] U.S. Cl. ..... 102/431; 102/439; 102/466; 102/700; 42/76.01

[58] Field of Search ..... 102/430–433, 102/439, 464–467, 700; 42/76.01

[56] References Cited

U.S. PATENT DOCUMENTS

| | | | |
|---|---|---|---|
| 2,072,671 | 3/1937 | Foulke | 102/430 |
| 4,535,697 | 8/1985 | Moser et al. | 102/464 |
| 4,887,534 | 12/1989 | Dickovich et al. | 102/430 |
| 5,333,551 | 8/1994 | Heitmann et al. | 102/431 |

FOREIGN PATENT DOCUMENTS

| | | | |
|---|---|---|---|
| 1 286 97 | 6/1950 | Sweden | 102/430 |

*Primary Examiner*—Harold J. Tudor
*Attorney, Agent, or Firm*—John F. Moran; Michael C. Sachs

[57] ABSTRACT

A tank cartridge is described which is capable of withstanding rough handling during loading and unloading operations.

5 Claims, 1 Drawing Sheet

10
12
14
15
16
18
20
21
22
23
24
26
28
30
32
34
36
38
40
42
44
46
48
50
52
52'
B
θ

TANK CARTRIDGE

GOVERNMENTAL INTEREST

This application claims benefit of provisional application 60/030,401 filed Oct. 29, 1996 and 60/045,998 filed May 8, 1997, the entire file wrapper contents of which application, are hereby incorporated by reference as though fully set forth a length.

The invention described herein may be manufactured, used and licensed by or for the U. S. Government for Governmental purposes.

BACKGROUND OF THE INVENTION

Tank cartridges are frequently subjected to rough handling during both transportation and usage. As a consequence of this adverse handling, the case components in prior art tank cartridges were particularly vulnerable to damage. A non-functioning round during wartime conditions can be disastrous to both armed forces personnel and equipment. In some tank rounds, such as in the 120 mm round, the case cap must be strong enough to hold a projectile weighing approximately 27 pounds. When a case cap is damaged by being smashed or cracked, the round may not be loadable into the tank gun, resulting not only in a monetary loss of a tank cartridge but also in unacceptable endangerment of personnel under combat conditions. A 120 mm round with a damaged or cracked prior art case cap frequently prevented the round from being properly chambered.

The present invention of an improved tank cartridge overcomes the aforementioned difficulties.

SUMMARY OF THE INVENTION

The present invention relates to a tank cartridge which is able to survive the typical rough handling that tank ammunition rounds are subjected to under both training and wartime battlefield conditions.

An object of the present invention is to provide a tank cartridge having a case cap which eliminates an interference fit with a tank gun tube forcing cone.

Another object of the present invention is to maintain mating characteristics as well as structured support with a prior art cartridge stabilizer.

Another object of the present invention is to reduce the free ullage space inside the tank round thereby improving ballistic safety because of reduced negative differential pressure.

Another object of the present invention is to provide a case cap geometry which is interchangeable with existing cartridge design.

Another object of the present invention is to provide a case cap having a continuously smooth exterior surface, thereby allowing for smooth loading.

Another object of the present invention is to provide for a case cap design thickness which allows for more resin impregnation, thereby providing added strength.

A further object of the present invention is to provide for a thicker case cap design for added strength without creating residue problems.

For a better understanding of the present invention, together with other and further objects thereof, reference is made to the following descriptions taken in connection with the accompanying drawings.

BRIEF DESCRIPTION OF THE DRAWINGS

Throughout the following description, like numerals are used to denote like parts of the drawings.

DETAILED DESCRIPTION OF THE PREFERRED EMBODIMENTS

Figures 1, 2, 3:
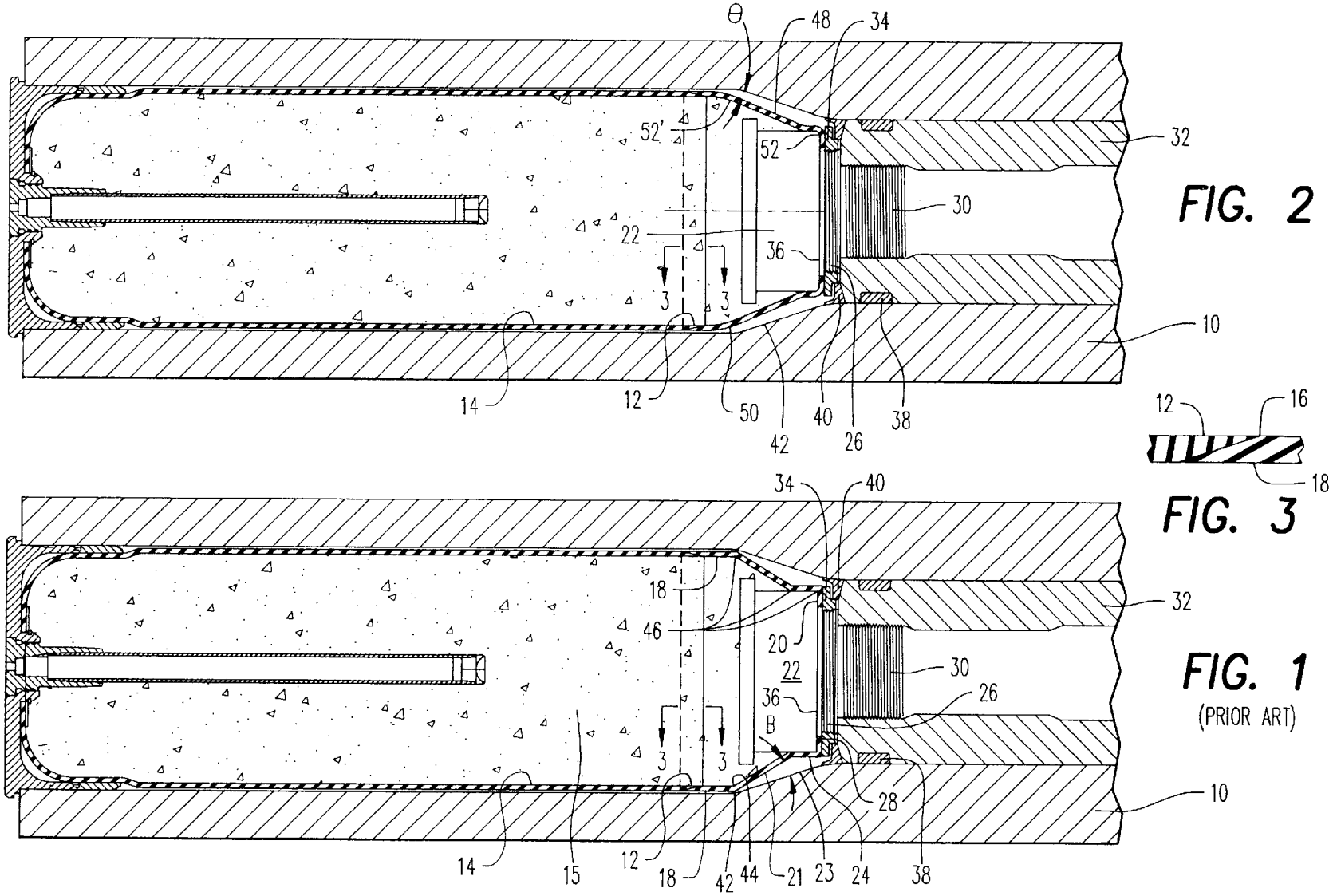
FIG. 1 (PRIOR ART)
FIG. 1 is a partial diametrical cross-sectional view of a prior art tank cartridge assembly shown in an in-breech position of a gun tube.
FIG. 2 is a partial diametrical cross-sectional view of the present improved tank cartridge assembly with the improved case cap in an in-breech position.
FIG. 3 is an enlarged detail of the skive joint taken along line 3—3 of FIGS. 1 and 2.

Referring now to FIGS. 1 and 3, a prior art tank round is shown in an in-breech position in a tank gun tube 10. A cartridge forward end 12 of resin impregnated cellulose cartridge case 14 forms a skive joint 16 with a rear end 18 of the prior art case cap 20. A propellant 15 is contained therein. A stabilizer member 22 fits snugly inside of a resin impregnated cellulose case cap 20 have a front end 24. An externally threaded first boss 26 passes through a front open face 28 of case cap 20. An axially aligned externally threaded second boss 30 is threadedly attached to an internally threaded projectile body 32. An internally threaded aluminum flange member 34 fixedly holds case cap front face 28 tightly against stabilizer shoulder 36. Obturator 38 and gasket 40 are operatively positioned to help prevent propellant gases from blowing by the projectile body 32. The problem with the prior art case cap 20 of FIG. 1 was that cracks frequently developed at the case cap projectile interface before and during the loading and unloading of the cartridge in the tank. One of the contributing factors to the case cap cracking problem during chambering was the interference fit between the gun forcing cone 42 and case cap shoulder 44. The conical shape case cap side 21 makes an angle $\beta$ with respect to gun tube forcing cone side 23 which is approximately 15 degrees. The prior art case cap design had sharp corners at points 46 which tended to exacerbate the cracking problems by increasing stress concentrations at these points.

Referring to FIG. 2, the new case cap 48 has a new exterior and interior configuration. The present case cap shoulder 50 has been moved back toward the skive joint 16, creating an angle $\theta$ between the case cap side wall 48 and forcing cone side wall 23 whose angle $\theta$ is less that prior art angle $\beta$. Preferably, the angle $\theta$ is 5 degrees or less. With a case cap design that does not possess the sharp corners at points 46 of the prior art, the case cap shoulder 50 does not abut the gun forcing cone 42. The reduced angle $\theta$ gives the present case cap 48 additional strength to sustain bending moments exerted by the projectile body 32 against case cap 48. The reduced angle $\theta$ on the present invention also allows the cartridge to move smoothly on a tank loading tray with less probability of cap shoulder damage. The reduced ullage space in a chambered round of the present invention, wherein the angle $\theta$ is less than the prior art angle $\theta$, increases the ballistic safety because of reduced negative differential pressure. The present resin impregnated cellulose case cap 48 has improved larger radii at corners 52 and 52', thereby preventing stress concentrations at these points. The present case cap is also thicker than the prior art case cap allowing for greater strength because of more resin impregnation. While a specific embodiment of the invention has been shown and described in detail to illustrate the application of the principles of the invention, it will be understood that the invention may be embodied otherwise without departing from such principles.

What is claimed is:

1. An improved tank cartridge which comprises:

a resin impregnated cellulose cartridge case for holding a propellant therein;

a resin impregnated cellulose case cap operatively connected to said cartridge case wherein said case cap retains propellant within said cartridge case and supports a projectile thereon, said case cap defining a reduced free ullage space inside said tank cartridge and a space between said cap and a forcing cone wall of a tank gun, a case cap rear end operatively connected to said cartridge case, said rear end forming a skive joint therebetween, said case cap having a case cap shoulder and a case cap side wall, said case cap shoulder operatively located proximate to said skive joint, said cap side wall and said shoulder located rearward of said forcing cone wall of said tank gun and forming an angle θ between said case cap side wall and said forcing cone wall, said angle θ being about 5 degrees or less; and stabilizer means operatively disposed in said case for fixedly holding a projectile in axial alignment with said cartridge case and said case cap.

2. The tank cartridge as recited in claim 1 wherein said case cap shoulder has a contour surface sufficient to prevent an interference fit between said case cap shoulder and said forcing cone wall when said tank cartridge is in an in-breech position.

3. The tank cartridge as recited in claim 2 wherein said case cap shoulder and said angle θ reduce the free ullage space within said tank cartridge.

4. The tank cartridge as recited in claim 3 wherein said case cap includes a continuously smooth exterior surface.

5. The tank cartridge as recited in claim 4 wherein said case cap includes a case cap front end having rounded interior corners.

* * * * *